US010421178B2

(12) United States Patent
Engel et al.

(10) Patent No.: US 10,421,178 B2
(45) Date of Patent: Sep. 24, 2019

(54) SWITCHABLE PLIERS AND METHOD FOR USE

(71) Applicant: A&E INCORPORATED, Racine, WI (US)

(72) Inventors: Bruce J. Engel, Milwaukee, WI (US); Jeffrey J. Kuzmic, Wind Lake, WI (US)

(73) Assignee: A & E Incorporated, Racine, WI (US)

( * ) Notice: Subject to any disclaimer, the term of this patent is extended or adjusted under 35 U.S.C. 154(b) by 426 days.

(21) Appl. No.: 15/288,621

(22) Filed: Oct. 7, 2016

(65) Prior Publication Data

US 2018/0099389 A1 Apr. 12, 2018

(51) Int. Cl.
*B25B 7/10* (2006.01)
*B25B 27/20* (2006.01)

(52) U.S. Cl.
CPC ..... *B25B 27/205* (2013.01); *B25B 7/10* (2013.01)

(58) Field of Classification Search
CPC ..... B25B 27/205; B25B 7/02; B25B 7/00; B25B 7/18; B25B 7/06; B25B 7/10
See application file for complete search history.

(56) References Cited

U.S. PATENT DOCUMENTS 1,122,165 A 12/1914 Schoening
1,558,399 A 10/1925 Rylen
1,867,912 A 7/1932 Evey
2,483,380 A 9/1949 Duffy
2,842,996 A 7/1958 Coslow
3,503,114 A 3/1970 Stanton
3,762,019 A 10/1973 Epstein
D273,455 S 4/1984 Teitelbaum
D276,880 S 12/1984 Tozaburo
4,572,179 A 2/1986 Tietelbaum
4,793,224 A * 12/1988 Huang ..... B25B 27/205 29/229
5,007,313 A 4/1991 Jeromson, Jr. et al.
5,065,650 A 11/1991 Anderson
5,174,177 A 12/1992 Jeromson, Jr. et al.
5,826,467 A 10/1998 Huang
5,865,075 A * 2/1999 Medved ..... B25B 27/205 29/229
6,006,633 A 12/1999 Kaiser
(Continued)

FOREIGN PATENT DOCUMENTS

FR 2292557 A1 6/1976
WO WO 2011/090983 1/2011

OTHER PUBLICATIONS

European Search Report pertaining to EP 17189649, dated Feb. 13, 2018, 7 pages.

(Continued)

*Primary Examiner* — Robert J Scruggs
(74) *Attorney, Agent, or Firm* — Ryan Kromholz & Manion, S.C.

(57) ABSTRACT

A pliers switchable for use with external snap-rings and internal snap-rings. The pliers has a first member with V-shape track, a second member with an aperture, and a switch mechanism. The second member and the switch mechanism are translatable along the V-shape track, and the switch mechanism is configured to engage and disengage the first and second members in and out of a "locked" position.

7 Claims, 4 Drawing Sheets

(56) References Cited

U.S. PATENT DOCUMENTS

| | | | | |
|---|---|---|---|---|
| 6,145,417 | A | 11/2000 | Bates | |
| 6,257,105 | B1 | 7/2001 | Lin | |
| 6,378,403 | B1 | 4/2002 | Bates | |
| 6,470,774 | B2 | 10/2002 | Chang | |
| 6,983,677 | B1 | 1/2006 | Engel | |
| 7,448,301 | B1 | 11/2008 | Cronin | |
| 8,347,471 | B2 | 1/2013 | Wang | |
| 2011/0214538 | A1 | 9/2011 | Huang | |
| 2013/0019720 | A1 * | 1/2013 | Harrison | B25B 27/205 81/409.5 |
| 2015/0298310 | A1 | 10/2015 | Cronin | |

OTHER PUBLICATIONS

Redline Detection, LLC; Rapid Shift Internal to External Circlip Pliers (Part No. RDL95-0200) http://www.olct.co/redline-detection/snap-ring-pliers-12-piece-set#, dated May 8, 2014.

* cited by examiner

SWITCHABLE PLIERS AND METHOD FOR USE

BACKGROUND OF THE INVENTION

Pliers, specifically snap-ring pliers are well known in the art. Snap-rings can be either "internal" or "external." In their neutral state, internal snap-rings are generally disposed in a slightly open-loop configuration. They may be used to retain a part within a cylinder, for example, retaining a bearing in a shaft. To install an internal snap-ring the open-loop end is closed to decrease the diameter to fit within the cylinder. The snap-ring is then allowed to open within the cylinder, ideally within a groove. On the other hand, external snap-rings may be used to retain an object on the external side of a shaft, for example, gears or pulleys on a shaft. External snap-rings are generally disposed in a closed-loop configuration. The closed-loop may be spread open to permit the external snap-ring to fit over a shaft, then once in place, the external snap-ring may be released, preferably in a groove about the shaft, to retain the object on the shaft.

Generally, there are internal snap-ring pliers used to install internal snap-rings and external snap-ring pliers to install external snap-rings. Internal snap-ring pliers may consist of a pair of handles which cross at a pivot pin and with a tip at the snap-ring interface end. The crossing configuration allows a closing action of the handles to translate into a closing action of the tips, thus a closing of the open-loop of the internal snap-ring. External snap-ring pliers may consist of a pair of handles connected at a pivot point but do not cross at the pivot point. This configuration allows a closing action of the handles to translate into an opening of the tips, thus spreading the external snap-ring.

Additionally, there are internal/external snap-ring pliers which allow a user to switch between an orientation for use with internal snap-rings and an orientation for use with an external snap-ring. Some switchable devices provide a first handle with a pivot pin affixed to it and a second handle with a V-shape track in which the first handle pin travels within. However, in some orientations during use, one of the handles will be displaced relative to the other due to the orientation of the pin and the groove and the spring force exhibited by a biased snap-ring. This will either twist the snap-ring, making alignment with the groove more difficult, or cause the pliers to disengage from one end of the snap-ring entirely. Accordingly, the art of snap-ring pliers could benefit from a more reliably engaged device capable of easily switching from an internal to an external snap-ring pliers and vice versa.

SUMMARY OF THE INVENTION

The present invention relates to a more reliably engaged switchable pliers which may be used with both internal and external snap-rings. The pliers has a first member with V-shape track, a second member with an aperture, and a switch mechanism. The second member and the switch mechanism are translatable along the V-shape track, and the switch mechanism is configured to engage and disengage the first and second members in and out of a "locked" position.

DESCRIPTION OF THE PREFERRED EMBODIMENT

Figure 1:
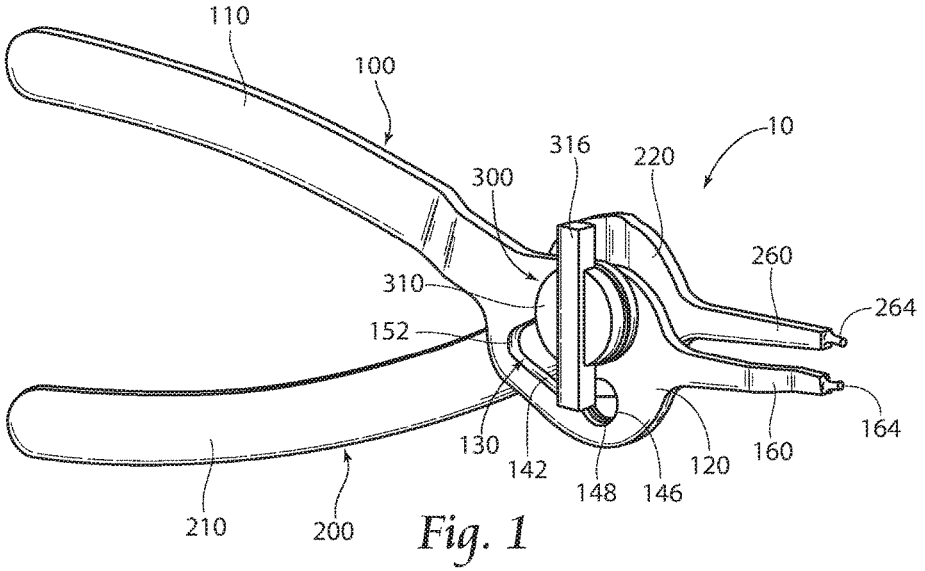
FIG. 1 is a perspective view of a switchable pliers according to the present invention.
Figure 2:
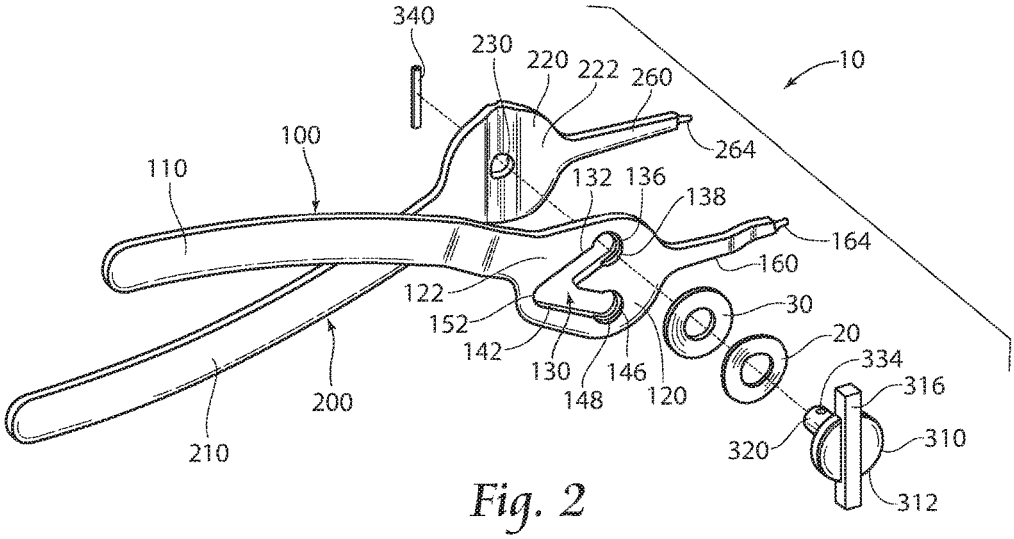
FIG. 2 is an exploded perspective view of the switchable pliers shown in FIG. 1.
Figure 3:
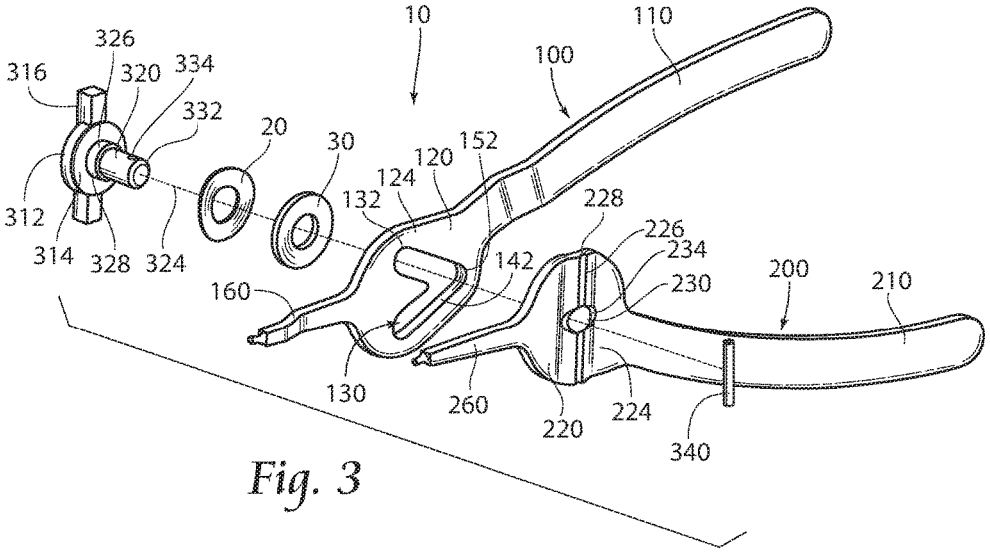
FIG. 3 is an exploded perspective view of the switchable pliers shown in FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

FIGS. 1-4B illustrate an embodiment 10 of a lockable switchable pliers according to the present invention. The pliers 10 comprises a first member 100, a second member 200, and a switch mechanism 300.

The first member 100 comprises a first member handle portion 110, a first member medial portion 120, and a first member tip portion 160. The first member medial portion 120 is preferably contiguous with the first member handle portion 110 and the first member tip portion 160. The first member 100 is preferably formed from a singular piece of material.

The first member handle portion 110 is preferably configured to be receivable within an operator's hand (not shown). Even more preferably the first member handle portion 110 is configured to be ergonomically formed to reduce user hand strain and fatigue. This can be accomplished by coating the first member handle portion 110 in a polymeric material as is known in the art and/or increasing the surface area in which the first member handle portion 110 contacts a user's hand (not shown).

The first member medial portion 120 preferably comprises a first surface 122, a second surface 124, and a V-shape track 130 which extends through the first member medial portion 120 from the first surface 122 through the second surface 124. The V-shape track 130 has a first stem 132 and a second stem 142, each having a width 134,144 and a distal end portion 136,146 and converging at a junction 152. The V-shape track 130 is preferably symmetrical and has a line of symmetry 154. The junction 152 is preferably positioned closest to the first member handle portion 110.

The distal end portions 136,146 of each of the first stem 132 and the second stem 142, respectively, preferably comprise a recess 138,148 extending from the first surface 122 towards the second surface 124. Additionally or alternatively, the recesses 138,148 may extend through the second surface 124. The recesses 138,148 are preferably circular with a recess diameter 140,150.

The first member tip portion 160 extends from the first member medial portion 120 in a direction substantially opposite the first member handle portion 110. The first member tip portion 160 has a length dimension 162 and terminates in a tip 164 configured to be received with a hole of a snap-ring (not shown). Preferably, the length dimension 162 is approximately in-line and/or parallel with the line of symmetry 154 of the V-shape track 130.

Similar to the first member 100, the second member 200 comprises a second member handle portion 210, a second member medial portion 220, and a second member tip portion 260. The second member medial portion 220 is preferably contiguous with the second member handle portion 210 and the second member tip portion 260. The second member 200 is preferably formed from a singular piece of material.

The second member handle portion 210 is preferably configured to be receivable within an operator's hand (not shown). Even more preferably the second member handle portion 210 is configured to be ergonomically formed to reduce user hand strain and fatigue. This can be accomplished by coating the second member handle portion 210 in a polymeric material as is known in the art and/or increasing the surface area in which the second member handle portion 210 contacts a user's hand (not shown).

The second member medial portion 220 preferably comprises a first surface 222, a second surface 224, and a through-hole 230 extending from the first surface 222 through the second surface 224. A ridge 226 with a ridge groove 228 extends across a portion of the second surface 224 in the area of the through-hole 230. The through-hole 230 is preferably centrally located on the ridge 226 and has a through-hole diameter 232 and chamfered portions 234 adjacent the ridge groove 228.

The second member tip portion 260 extends from the second member medial portion 220 in a direction substantially opposite the second member handle portion 210. The second member tip portion 260 has a length dimension 262 and terminates in a tip 264 configured to be received with a hole of a snap-ring (not shown). Preferably, the length dimension 262 is approximately perpendicular to the ridge groove 228 of the second member medial portion 220.

The switch mechanism 300 preferably comprises a switch member 310, a spring washer 20, a flat washer 30, and a pin 340.

The switch member 310 preferably comprises a body 312, a shaft 320, and a pin 340. The body 312 has a body surface 314 from which extends the shaft 320 with a central axis 324. The body 312 also preferably has a lever member 316 extending outward from the body 312 to increase the mechanical advantage when a user (not shown) turns the body 312 about the central axis 324.

The shaft 320 is preferably cylindrical with a shaft diameter 322 and has a proximal end portion 326 and a distal end portion 332. The proximal end portion 326 has a collar 328 with a collar diameter 330. The distal end portion 332 preferably has a shaft through-hole 334 extending through the shaft 320 preferably perpendicular to the central axis 324 and parallel with the lever member 316.

The spring washer 20 is preferably located on the shaft 320 and abutting the body surface 314. The flat washer 30 is located on the shaft 320 adjacent the spring washer 20. The shaft 320 is received through the V-shape track 130 of the first member medial portion 120 and the through-hole 230 of the second member medial portion 220. The pin 340 is located in the shaft through-hole 334 to maintain the placement of the switch member 310.

The widths 134,144 of the first stem 132 and the second stem 142 of the V-shape track 130 are preferably larger in dimension than the shaft diameter 322 and smaller in dimension than the collar diameter 330. The recess diameters 140,150 at the distal end portions 136, 146 of the first stem 132 and the second stem 142 of the V-shape track 130 are preferably larger in dimension than the collar diameter 330.

A method for switching the pliers 10 from an internal snap-ring position (FIG. 4) to an external snap-ring position (FIG. 8) is depicted in FIGS. 4-8. It should be noted that the reverse operation (i.e., switching the pliers 10 from an external snap-ring position to an internal snap-ring position) may be accomplished in a similar fashion by reversing the steps herein provided. Also, the steps are provided according to the orientation of the pliers 10 in the figures and should not be considered limiting.

Figure 4:
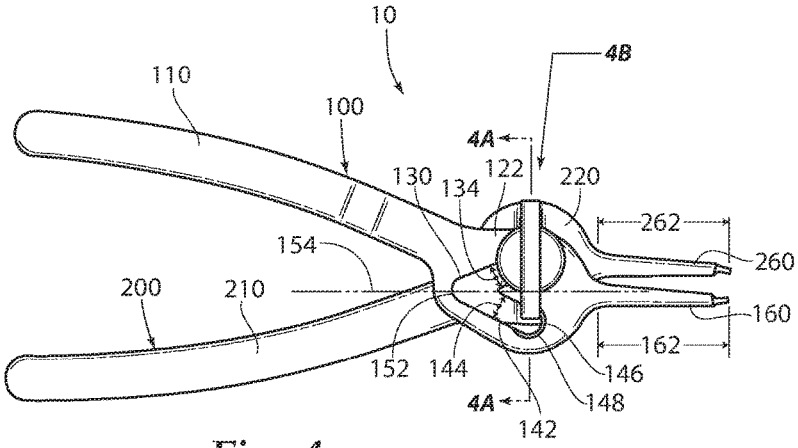
FIG. 4 is a top plan view of the switchable pliers shown in FIG. 1.
Figure 4A:
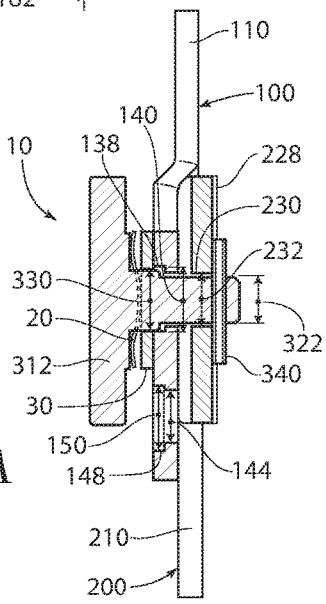
FIG. 4A is a cross-sectional view of the switchable pliers along line 4A-4A in FIG. 4.
Figure 4B:
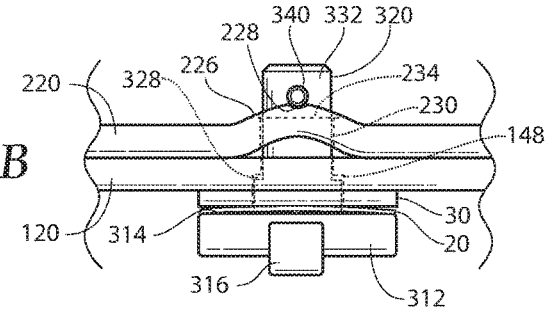
FIG. 4B is a sectional view of the switchable pliers at section 4B in FIG. 4.

FIG. 4 illustrates the pliers in an internal snap-ring position in which bringing the first and second member handle portions 110,210 closer will also move the first and second member tip portions 160,260 closer together. As seen in FIGS. 4A and 4B, the shaft 320 of the switch member 310 is located in the distal end portion 136 of the first stem 132 of the V-shape track 130 with the collar 328 within the recess 138 and the pin 340 within the ridge groove 228. The spring washer 20 is compressed between the flat washer 30 and the body surface 314 of the body 312, encouraging the pin 340 to remain in the ridge groove 228.

Figure 5:
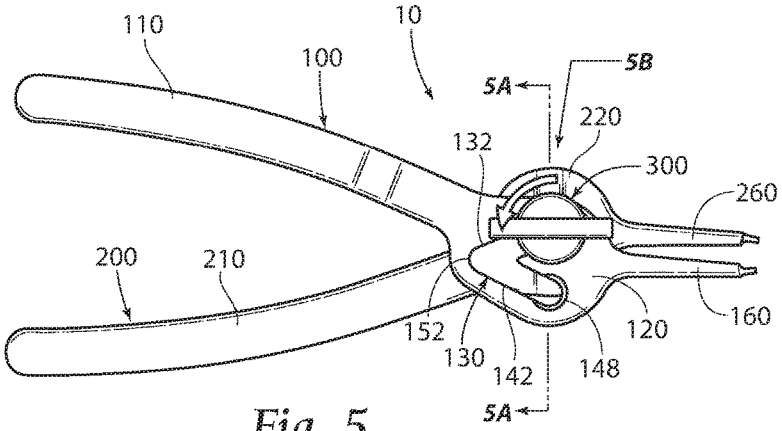
FIG. 5 is a top plan view of the switchable pliers shown in FIG. 1.
Figure 5A:
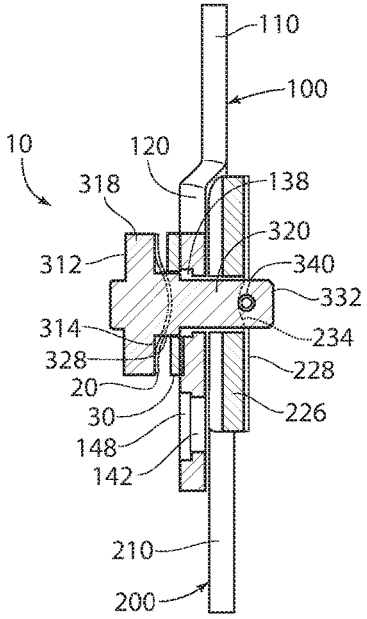
FIG. 5A is a cross-sectional view of the switchable pliers along line 5A-5A in FIG. 5.
Figure 5B:
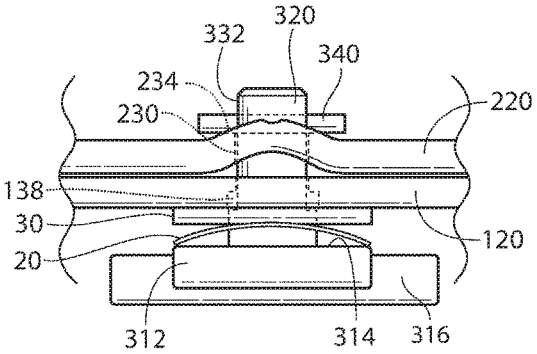
FIG. 5B is a sectional view of the switchable pliers at section 5B in FIG. 5.

To begin the transition from internal snap-ring pliers to external snap-ring pliers, the switch member 310 is rotated approximately 90 degrees in either a clockwise direction or a counter-clockwise direction as shown in FIG. 5. As illustrated in FIGS. 5A and 5B, the spring washer 20 provides a biasing force between the flat washer 30 and the body surface 314 of the body 312, thereby positioning the pin 340 within the chamfered portions 234 of the through-hole 230 and moving the collar 328 of the shaft 320 outside of the recess 138. As the collar 328 is no longer within the recess 138, s the first member 100 is now capable of translating via the V-shape track 130 relative to the second member 200.

Figure 6:
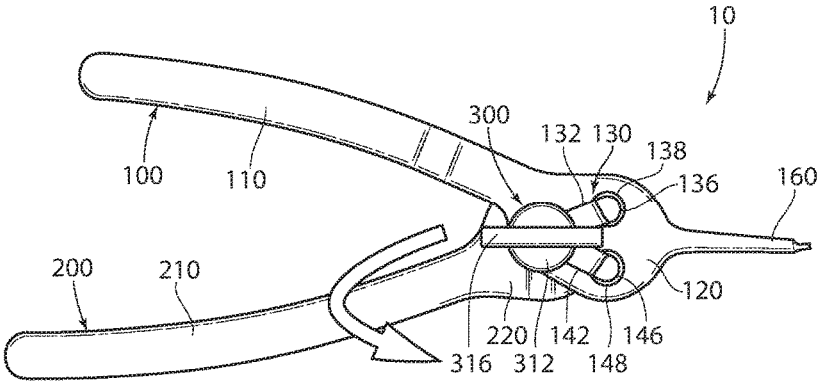
FIG. 6 is a top plan view of the switchable pliers shown in FIG. 1.
Figure 7:
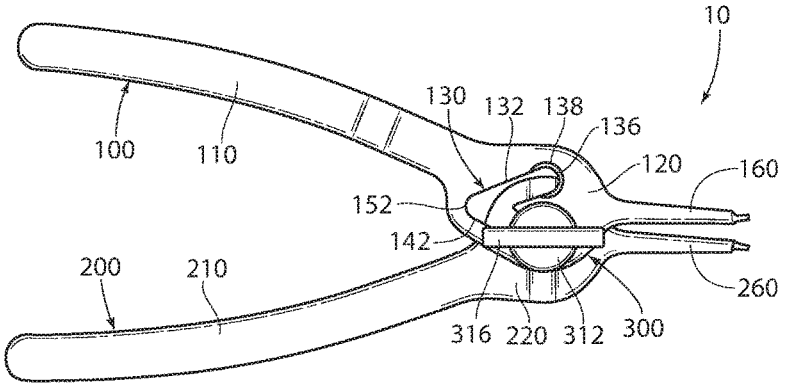
FIG. 7 is a top plan view of the switchable pliers shown in FIG. 1.

FIG. 6 illustrates translating the second member 200 and the switch mechanism 300 from the distal end portion 136 to the junction 152 along the first stem 132 of the V-shape track 130. The first member tip 160 and the second member tip portion 260 cross past each other. The second member 200 and the switch mechanism 300 are moved from the junction 152 along the second stem 142 of the V-shape track 130 to the distal end portion 146 as shown in FIG. 7.

Figure 8:
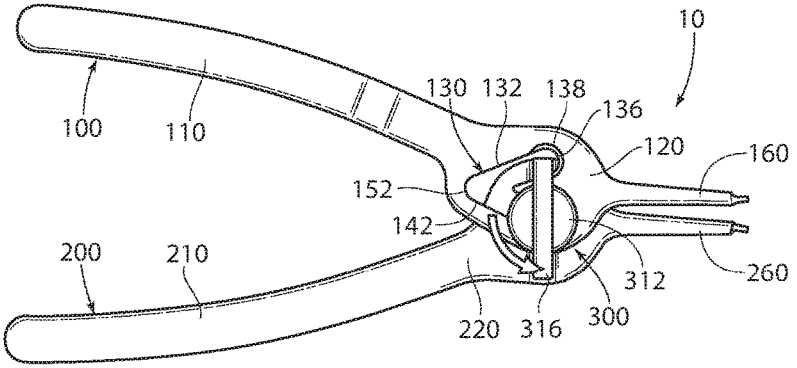
FIG. 8 is a top plan view of the switchable pliers shown in FIG. 1.

As shown in FIG. 8, the switch member 310 is rotated approximately 90 degrees in either a clockwise direction or a counter-clockwise direction as illustrated. Similar to the configuration provided in FIGS. 4A and 4B (and with reference thereto), the shaft 320 of the switch member 310 is located in the distal end portion 146 of the second stem 142 of the V-shape track 130 with the collar 328 within the recess 148 and the pin 340 within the ridge groove 228. The spring washer 20 is compressed between the flat washer 30 and the body surface 314 of the body 312, encouraging the pin 340 to remain in the ridge groove 228. The transition from internal snap-ring pliers to external snap-ring pliers is complete.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A pliers comprising:

a first member having a first member medial portion between a first member handle portion and a first member tip portion;

the first member medial portion having a first surface opposite a second surface and a V-shape track extending through the first member medial portion from the first surface through the second surface, the V-shape track having a first stem and a second stem;

a second member having a second member medial portion between a second member handle portion and a second member tip portion;

a ridge carried by said second member medial portion;

a ridge groove extending along said ridge;

a void space through said ridge and said ridge groove;

a switch mechanism comprising a switch member having a body and a shaft extending from the body, said shaft carrying a pin;

said shaft of said switch member extending through said void space through said ridge and said ridge groove, and said shaft of said switch member extending through the V-shape track of the first member;

said pin selectively positioned by said switch mechanism between a first, nested position as said ridge groove and said pin are parallel; and a second, unnested position as said ridge groove and said pin are non-parallel;

said first and said second member tip portions fixed in one of a first, spreading relationship and a second, closing relationship as said pin is in said first, nested position;

said first and said second member tip portions reversible between said spreading relationship and said closing relationship as said pin is in said second, unnested position.

2. The pliers of claim 1, wherein the first stem of the V-shape track has a first stem width and a first stem distal end portion with a recess with a recess diameter;

the second stem of the V-shape track has a second stem width and a second stem distal end portion with a recess with a recess diameter;

the shaft of the switch member has a shaft diameter, a proximal end portion, and a distal end portion, the proximal end portion having a collar with a collar diameter, the distal end having the shaft through-hole; and wherein the collar diameter is larger than the first and second stem widths and smaller than first and second stem distal end portion recess diameters.

3. The pliers of claim 2, wherein the switch mechanism further comprises a spring washer configured to be placed around the collar of the shaft.

4. The pliers of claim 3, wherein the ridge has a ridge groove configured to selectively receive the pin there along.

5. The pliers of claim 4, wherein the spring washer is configured to apply a biasing force between the switch member and the first surface of the first member to retain the pin within the ridge groove and the collar within either the first recess or the second recess.

6. A method for changing a convertible snap-ring pliers convertible from a first state and a second state, the method comprising the steps of:

providing a pliers comprising:

a first member having a first member medial portion between a first member handle portion and a first member tip portion;

the first member medial portion having a first surface opposite a second surface and a V-shape track extending through the first member medial portion from the first surface through the second surface, the V-shape track having a first stem with a first stem distal end portion and a second stem with a second stem distal end portion;

a second member having a second member medial portion between a second member handle portion and a second member tip portion;

the second member medial portion having a first surface opposite a second surface with a ridge with a ridge groove, and a through-hole extending from the first surface through the ridge of second surface;

a switch mechanism comprising a switch member having a body and a shaft extending from the body, said shaft carrying a pin;

said shaft of said switch mechanism extending through said void space through said ridge and said ridge groove, and said shaft of said switch member extending through the V-shape track of the first member;

said pin selectively positioned by said switch mechanism between a first, nested position as said ridge groove and said pin are parallel; and a second, unnested position as said ridge groove and said pin are non-parallel;

said first and said second member tip portions fixed in one of a first, spreading relationship and a second, closing relationship as said pin is in said first, nested position;

said first and said second member tip portions reversible between said spreading relationship and said closing relationship as said pin is in said second, unnested position;

rotating the pin from said first, nested position to said second, unnested position;

moving the shaft, with attached second member, along the first stem away from the first stem distal portion to the second stem;

moving the shaft along the second stem to the second stem distal end portion; and rotating the pin from said second unnested position to said first, nested position.

7. The method of claim 6, wherein the the first stem distal end portion has a recess with a recess diameter;

the second stem distal end portion has a recess with a recess diameter;

the shaft of the switch member has a shaft diameter, a proximal end portion, and a distal end portion, the proximal end portion having a collar with a collar diameter, the distal end having the shaft through-hole;

wherein the collar diameter is larger than the first and second stem widths and smaller than first and second stem distal end portion recess diameters;

the switch mechanism further comprises a spring washer configured to be placed around the collar of the shaft and provides a biasing force; and wherein the method further comprises the step of maintaining the collar within the recess of the second stem distal end portion with the biasing force.

* * * * *